US010864132B1

(12) United States Patent
Bingham

(10) Patent No.: US 10,864,132 B1
(45) Date of Patent: Dec. 15, 2020

(54) UPRIGHT EXTENSION FOR PERSONAL WALKERS

(71) Applicant: Paul Bingham, N Las Vegas, NV (US)

(72) Inventor: Paul Bingham, N Las Vegas, NV (US)

( * ) Notice: Subject to any disclaimer, the term of this patent is extended or adjusted under 35 U.S.C. 154(b) by 0 days.

(21) Appl. No.: 16/788,414

(22) Filed: Feb. 12, 2020

(51) Int. Cl.
*A61H 3/00* (2006.01)

(52) U.S. Cl.
CPC ..... *A61H 3/00* (2013.01); *A61H 2003/006* (2013.01); *A61H 2201/1638* (2013.01); *A61H 2201/1664* (2013.01)

(58) Field of Classification Search
CPC ..... A61H 3/00; A61H 2201/1638; A61H 2003/006
USPC ..... 135/67, 72
See application file for complete search history.

(56) References Cited

U.S. PATENT DOCUMENTS 2,362,466 A * 11/1944 Carter ..... 297/6
4,248,256 A * 2/1981 Thomas ..... A61H 3/00 135/67
4,411,283 A * 10/1983 Lucarelli ..... A61H 3/00 135/67
5,224,717 A * 7/1993 Lowen ..... A61H 3/04 135/67
5,411,044 A 5/1995 Andolfi
5,502,851 A 4/1996 Costello
5,657,783 A * 8/1997 Sisko ..... A61H 3/00 135/66
6,279,591 B1 * 8/2001 Obitts ..... A61H 3/00 135/66
7,275,554 B2 10/2007 Mullholand
8,540,256 B1 * 9/2013 Simpson ..... A61H 3/00 280/87.05
2008/0154165 A1 6/2008 Ashihara
2016/0067137 A1 3/2016 Little
2016/0166454 A1 6/2016 Johnson

* cited by examiner

*Primary Examiner* — Noah Chandler Hawk

(57) ABSTRACT

An upright extension for personal walkers for supporting users of personal walkers in an upright position includes a cross-member. The cross-member is removably coupled to a cross-brace of a walker. The cross-member has a first end and a second end orientated opposite each other. A coupler removably couples the cross-member to the cross-brace. A pair of lateral members extends rearwardly from each of a one of the first and second ends. Each of the pair of lateral members has a support attached to a distal end with regard to the cross-member. Each of the supports extends outwardly away from the pair of lateral members. Each of a pair of vertical members extends upwardly from a one of the lateral members adjacent to a one of the first and second ends. Each of the pair of vertical members has a grip and an armrest extending rearwardly.

11 Claims, 5 Drawing Sheets

UPRIGHT EXTENSION FOR PERSONAL WALKERS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to personal walker extension devices and more particularly pertains to a new personal walker extension device for supporting users of personal walkers in an upright position. The disclosure allows a person to operate a walker from a more upright posture by attaching to existing walkers.

(2) Description of Related Art Including Information Disclosed Under 37 CFR 1.97 and 1.98

The prior art relates to personal walker extension devices. The prior disclosures tend to refer to modified walkers which the user is attached or supported by structural components of the redesigned walker devices.

BRIEF SUMMARY OF THE INVENTION

An embodiment of the disclosure meets the needs presented above by generally comprising a cross-member. The cross-member is removably coupled to a cross-brace of a walker. The cross-member has a first end and a second end orientated opposite each other. A coupler removably couples the cross-member to the cross-brace of the walker. A pair of lateral members is each attached to and extends rearwardly from a one of the first end and the second end of the cross-member. Each of the pair of lateral members has a support attached to a distal end with regard to the cross-member. Each of the supports extends outwardly away from the pair of lateral members with respect to the cross-member. A pair of vertical members is each attached to and extends upwardly from a one of the lateral members positioned adjacent to a one of the first end and the second end of the cross-member. A pair of grips is each attached to a one of the pair of vertical members. A pair of armrests is attached to and extends rearwardly from each of the pair of vertical members.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
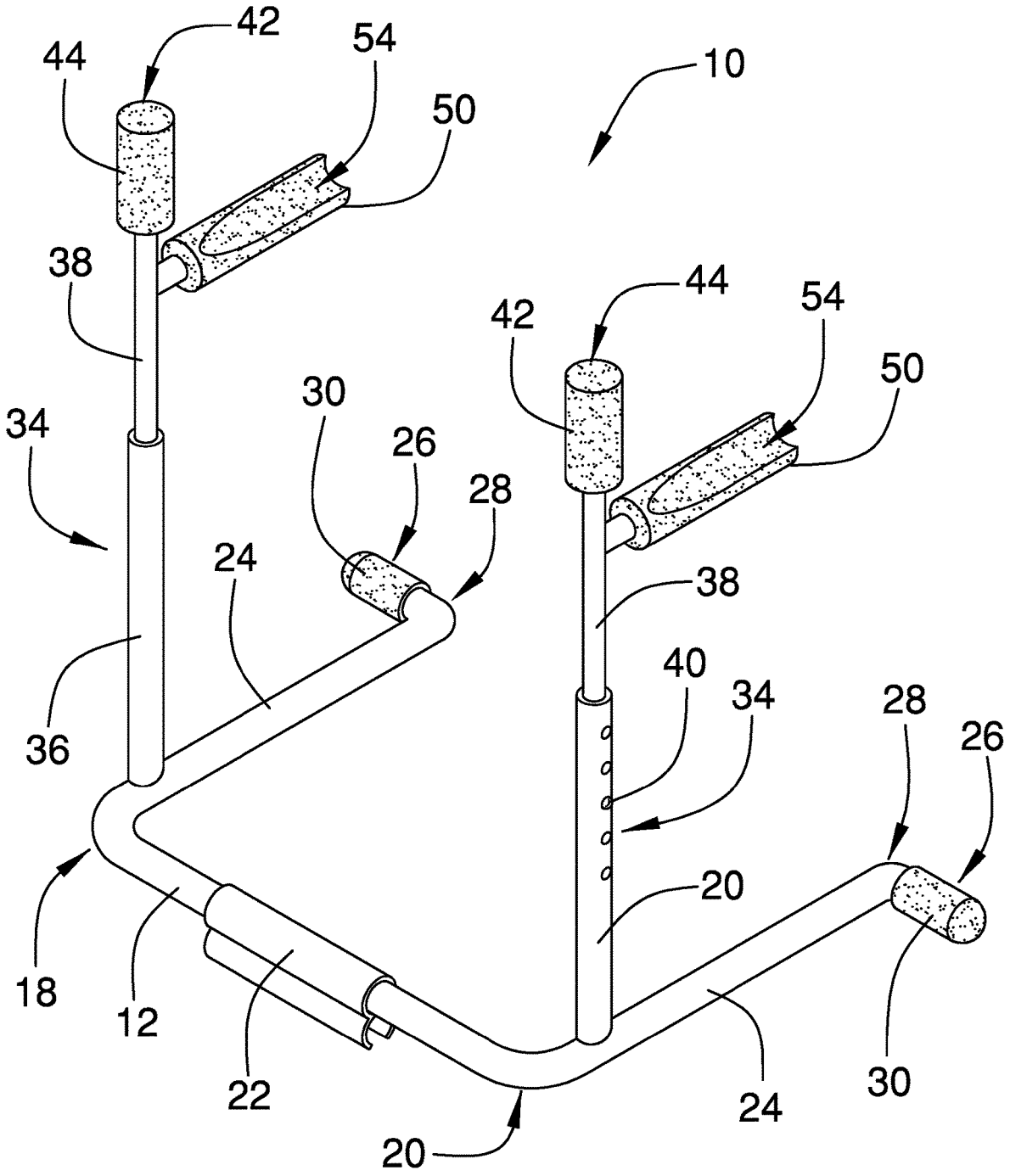
FIG. 1 is a top isometric view of an upright extension for personal walkers according to an embodiment of the disclosure.
Figure 2:
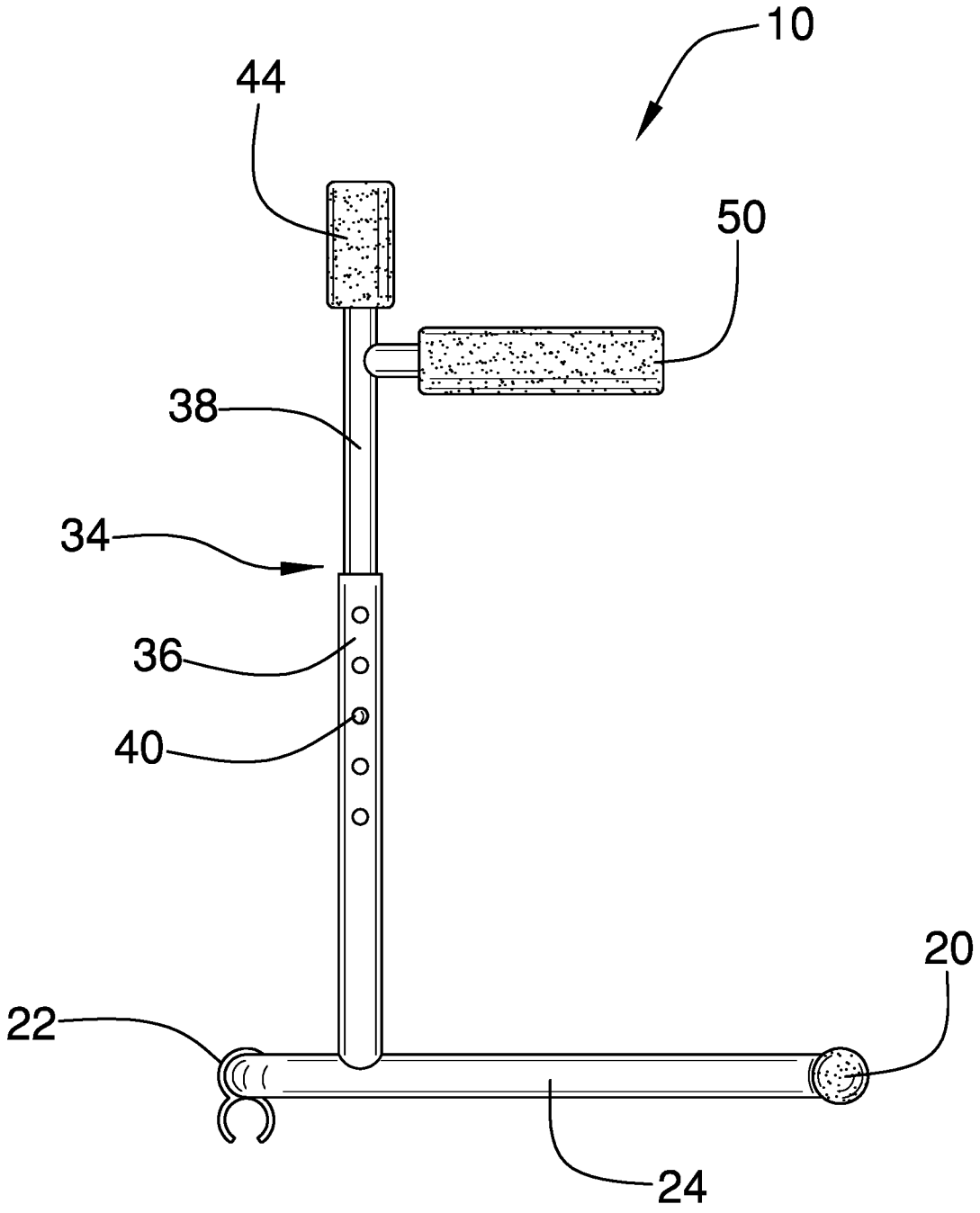
FIG. 2 is a side view of an embodiment of the disclosure.
Figure 3:
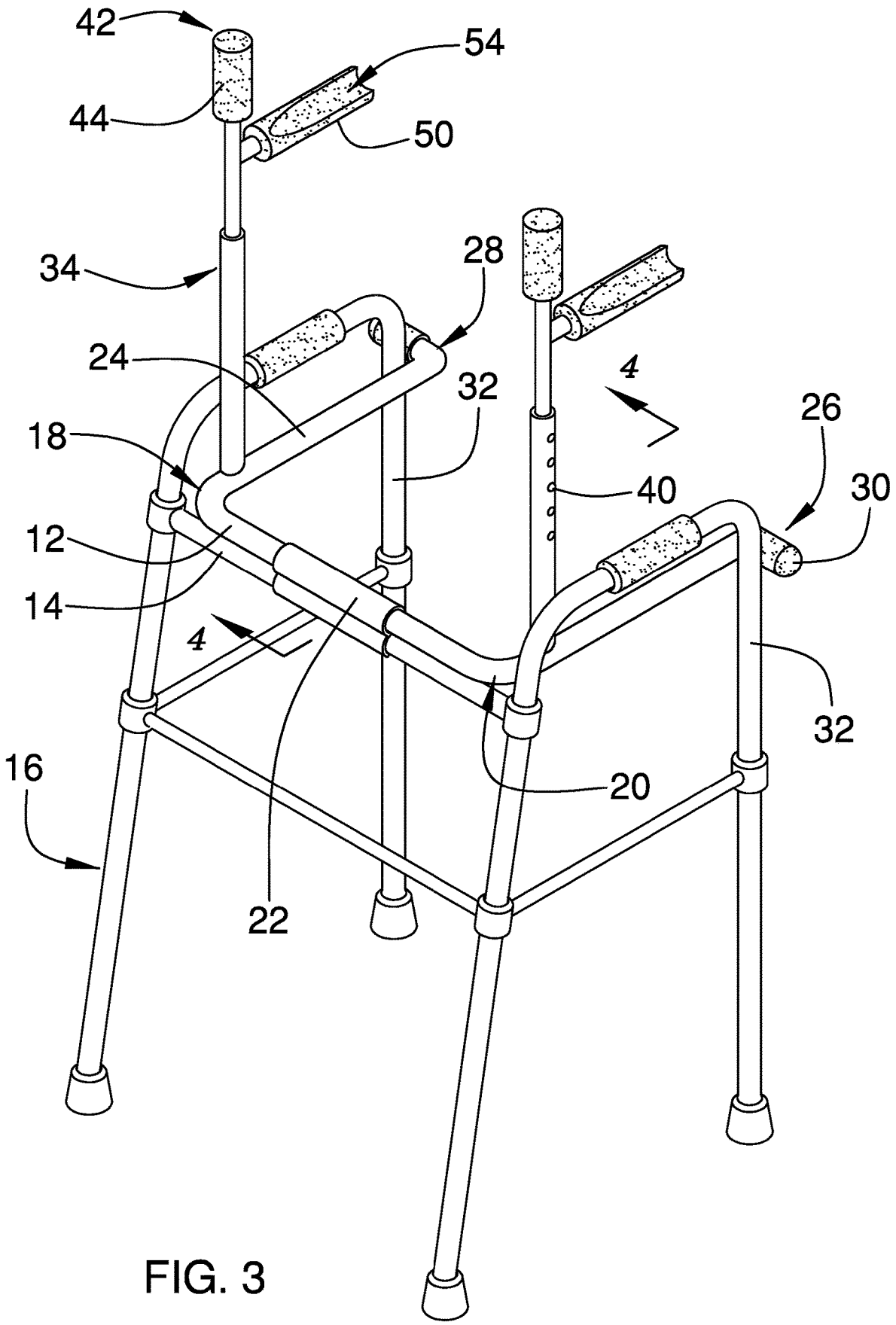
FIG. 3 is a top isometric view of an embodiment of the disclosure as attached to the walker.
Figure 4:
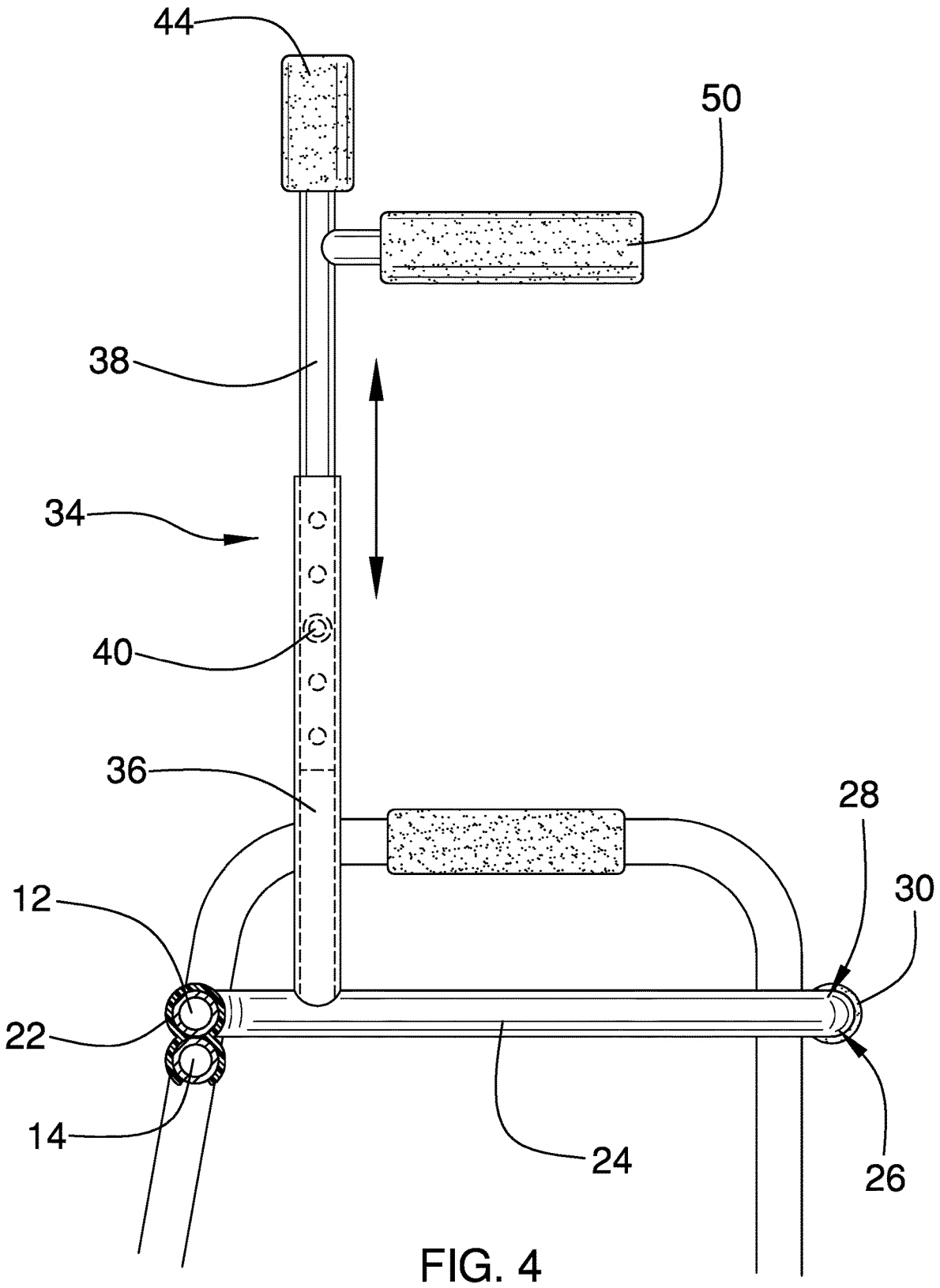
FIG. 4 is a cross-sectional view of an embodiment of the disclosure taken along line 4-4 in FIG. 3.
Figure 5:
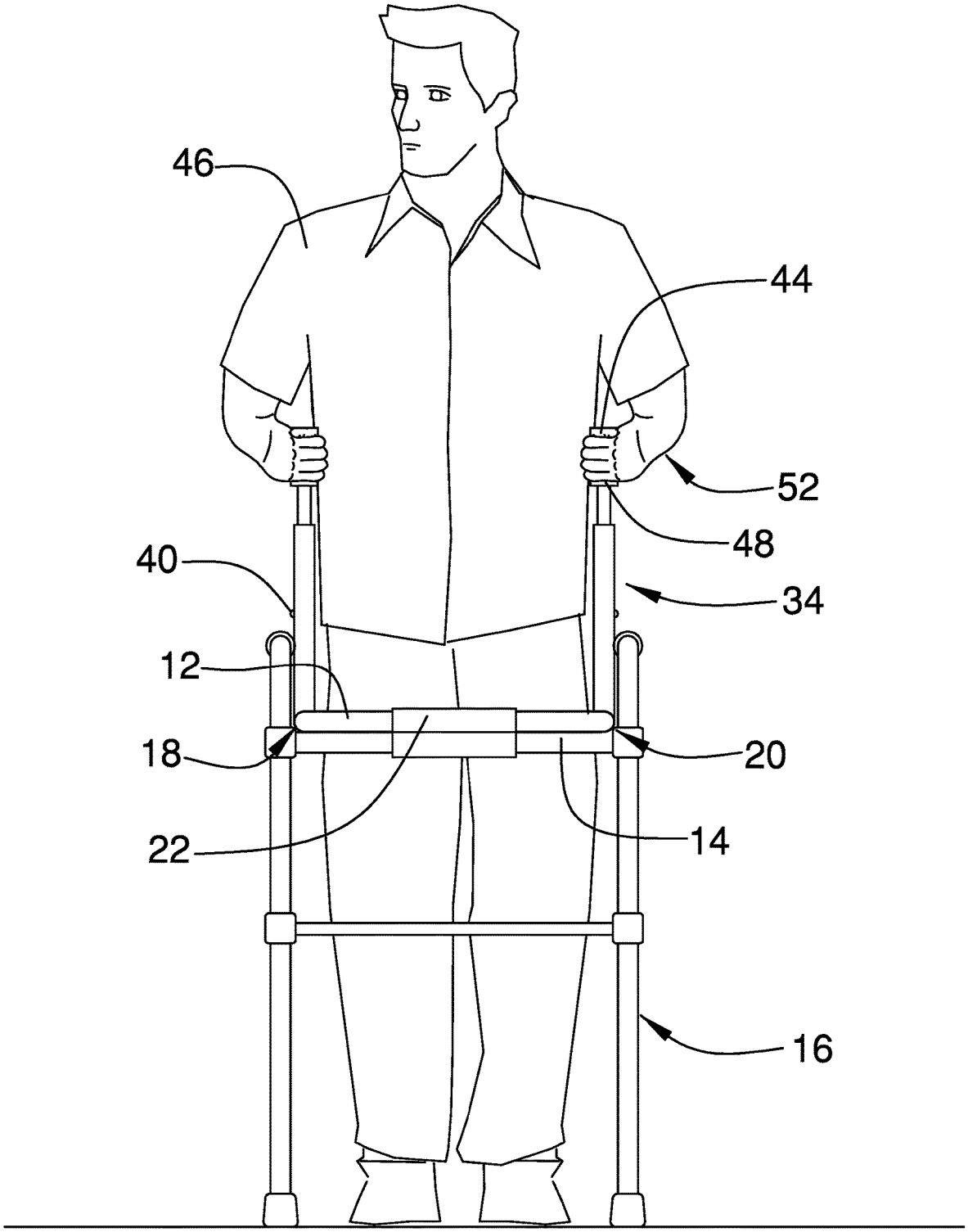
FIG. 5 is an in-use view of an embodiment of the disclosure.

With reference now to the drawings, and in particular to FIGS. 1 through 5 thereof, a new personal walker extension device embodying the principles and concepts of an embodiment of the disclosure and generally designated by the reference numeral 10 will be described.

As best illustrated in FIGS. 1 through 5, the upright extension for personal walkers 10 generally comprises a cross-member 12. The cross-member 12 is removably coupled to a cross-brace 14 of a walker 16. The cross-member 12 has a first end 18 and a second end 20 orientated opposite each other. The cross-member 12 is cylindrical in shape. The cross-member 12 is comprised of a rigid structural material including rigid plastics, wood, metal, or other conventionally available rigid materials. The cross-member 12 and cross-brace 14 may comprise the same or similar materials.

A coupler 22 removably couples the cross-member 12 to the cross-brace 14 of the walker 16. The coupler 22 is positioned between the first end 18 and the second end 20. The coupler 22 may removably attach the cross-member 12 to the cross-brace 14 using any conventionally available mechanical, magnetic, or electromagnetic coupling method. Suitable methods may involve fasteners, magnets, or other conventionally available methods of attachment suitable to secure and support the cross-member 12 to the walker 16.

A pair of lateral members 24 wherein each attaches to and extends rearwardly from a one of the first end 18 and the second end 20 of the cross-member 12. Each of the pair of lateral members 24 has a support 26 attached to a distal end 28 with regard to the cross-member 12. Each of the supports 26 extends outwardly away from the pair of lateral members 24 with respect to the cross-member 12. A securing pad 30 is attached to and covers an exterior of the supports 26. Each of the securing pads 30 engages with a one of a pair of rear legs 32 of the walker 16. Each of the lateral members 24 and supports 26 may be made of the same or similar materials to the cross-member 12. Each of the securing pads 30 is comprised of a resiliently compressible material. The resiliently compressible material is capable of increasing the friction force between the support 26 and the rear leg 32. Suitable materials for the resiliently compressible material include synthetic or natural fabrics, foam materials, natural or synthetic rubbers, or other conventionally used materials.

A pair of vertical members 34 each is attached to and extends upwardly from a one of the lateral members 24. Each of the pair of vertical members 34 is positioned adjacent to a one of the first end 18 and the second end 20 of the cross-member 12. Each of the pair of vertical members 34 comprises a first section 36, a second section 38, and a locking member 40. The first section 36 is attached to a one of the lateral members 24. The second section 38 is telescopically coupled to and extends upwardly away from the first section 36. The second section 38 has an end wall 42 positioned opposite the lateral member 24. The locking member 40 releasably engages each of the first section 36 and the second section 38 to selectively secure the first section 36 and the second section 38 at a chosen position relative to each other. The locking member 40 may use any one of a variety of mechanical locking methods including a friction lock, a biased detent and aperture method, or any other conventionally available mechanical methods. The vertical members 34 may be comprised of the same or similar materials as the cross-member 12.

Each of a pair of grips 44 is attached to a one of the vertical members 34. Each of the pair of grips 44 is positioned around a portion of a one of the second sections 38 adjacent to a one of the end walls 42. The pair of grips 44 is configured to allow a user 46 to hold and move the walker 16 when holding each of the grips 44 in the user's hands 48. Each of the pair of grips 44 may be comprised of the same or similar resiliently compressible material as the securing pads 30.

Each of a pair of armrests 50 is attached to and extends rearwardly from a one of the pair of vertical members 34. Each of the pair of armrests 50 is positioned on a one of the second sections 38 between a one of the grips 44 and a one of the first sections 36 such that a forearm 52 of the user 46 rests upon the armrest 50 while the user's hands 48 are engaged with the grips 44. Each of the pair of armrests 50 may extend rearwardly and outwardly to improve comfort of the user 46. Each of the pair of armrests 50 may be coated or comprised of the same or similar resiliently compressible material as the securing pads 30. Each of said pair of armrests 50 may have an indention or groove 54 to improve comfort of the forearm 52 of the user 46 during use.

In use, the cross-member 12 is attached to the cross-brace 14 of the walker 16 using the coupler 22. Each of the hands 48 of the user 46 engage with a one of the grips 50 while each of the forearms 52 of the user 46 engage with a one of the armrests 50. The weight of the user 46 engages the securing pads 30 with the rear legs 32 of the walker 16 which, along with the cross-member 12, help support the user 46 in an upright position while maneuvering the walker 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An upright extension assembly being configured to attach to a walker to support a person in an upright position during use of the walker, said assembly comprising:

a cross-member being removably coupled to a cross-brace of a walker, said cross-member having a first end and a second end orientated opposite each other;

a coupler removably coupling said cross-member to said cross-brace of the walker;

a pair of lateral members each being attached to and extending rearwardly from a one of said first end and said second end of said cross-member, each of said pair of lateral members having a support being attached to a distal end with regard to said cross-member, each of said supports extending outwardly away from said pair of lateral members with respect to said cross-member;

a pair of vertical members each being attached to and extending upwardly from a one of said lateral members positioned adjacent to a one of said first end and said second end of said cross-member;

a pair of grips each being attached to a one of said pair of vertical members; and a pair of armrests being attached to and extending rearwardly from each of said pair of vertical members.

2. The upright extension assembly according to claim 1, wherein said cross-member is cylindrical in shape.

3. The upright extension assembly according to claim 1, wherein said coupler is positioned between said first end and said second end.

4. The upright extension assembly according to claim 1, wherein a securing pad is attached to and covers an exterior of said supports.

5. The upright extension assembly according to claim 4, wherein each of said securing pads engages with a one of a pair of rear legs of the walker.

6. The upright extension assembly according to claim 1, wherein each of said pair of vertical members comprises:

a first section being attached to a one of said lateral members;

a second section being telescopically coupled to and extending upwardly away from said first section;

a locking member releasably engaging each of said first section and said second section to selectively secure said first section and said second section at a chosen position relative to each other.

7. The upright extension assembly according to claim 6, wherein said second section has an end wall positioned opposite said lateral member.

8. The upright extension assembly according to claim 7, wherein each of said pair of grips being positioned around a portion of a one of said second sections adjacent to a one of said end walls.

9. The upright extension assembly according to claim 1, wherein said pair of grips allow a user to hold and move the walker when holding each of said grips in the user's hands.

10. The upright extension assembly according to claim 1, wherein each of said pair of armrests is positioned on a one of said second sections between a one of said grips and a one of said first sections such that a forearm of the user rests upon said armrest while the user's hands are engaged with said grips.

11. An upright extension assembly being configured to attach to a walker to support a person in an upright position during use of the walker, said assembly comprising:

a cross-member being removably coupled to a cross-brace of a walker, said cross-member having a first end and a second end orientated opposite each other, said cross-member being cylindrical in shape;

a coupler removably coupling said cross-member to said cross-brace of the walker, said coupler being positioned between said first end and said second end;

a pair of lateral members each being attached to and extending rearwardly from a one of said first end and said second end of said cross-member, each of said pair of lateral members having a support being attached to a distal end with regard to said cross-member, each of said supports extending outwardly away from said pair of lateral members with respect to said cross-member, a securing pad being attached to and covering an exterior of said supports, each of said securing pads engaging with a one of a pair of rear legs of the walker;

a pair of vertical members each being attached to and extending upwardly from a one of said lateral members, each of said pair of vertical members being positioned adjacent to a one of said first end and said second end of said cross-member, each of said pair of vertical members comprising:

a first section being attached to a one of said lateral members;

a second section being telescopically coupled to and extending upwardly away from said first section, said second section having an end wall positioned opposite said lateral member;

a locking member releasably engaging each of said first section and said second section to selectively secure said first section and said second section at a chosen position relative to each other;

a pair of grips each being attached to a one of said vertical members, each of said pair of grips being positioned around a portion of a one of said second sections adjacent to a one of said end walls, said pair of grips being configured to allow a user to hold and move the walker when holding each of said grips in the user's hands; and a pair of armrests each being attached to and extending rearwardly from a one of said pair of vertical members, each of said pair of armrests being positioned on a one of said second sections between a one of said grips and a one of said first sections such that a forearm of the user rests upon said armrest while the user's hands are engaged with said grips.

* * * * *